United States Patent [19]

Grigorenko et al.

[11] Patent Number: 4,624,386

[45] Date of Patent: Nov. 25, 1986

[54] EASY OPENING CAN TOP

[76] Inventors: Donald C. Grigorenko, 8625 Dunblane Ct., Dublin, Ohio 43017; Gerald C. Gardner, 305 Heathcote Rd., Hendersonville, N.C. 28739

[21] Appl. No.: 798,813

[22] Filed: Nov. 18, 1985

[51] Int. Cl.[4] ..... B65D 41/32

[52] U.S. Cl. ..... 220/269; 220/258

[58] Field of Search ..... 220/269, 270, 258, 259

[56] References Cited

U.S. PATENT DOCUMENTS 2,261,117 11/1941 Jack, Jr. ..... 220/269

4,051,976 10/1977 Perry ..... 220/269

*Primary Examiner*—George T. Hall

*Attorney, Agent, or Firm*—William S. Rambo; Wm. Cates Rambo

[57] ABSTRACT

An easy opening top for a beverage-can is formed by presscutting and bending a comparatively thin sheet steel blank to form therein an included opening underlaid by a correspondingly shaped pull tab or tongue which is joined with the blank along a single bend line. The metal of the blank is stretched and thinned slightly in the area of the bend line to cause at least part of the marginal edge of the tongue or tab to underlie an edge of the blank adjacent the opening therein and thereby prevent accidental displacement of the tongue upwardly through the opening in the can top. A thin film of synthetic resin material is adhesively secured to the underside of the can top in underlying relation to the pull tab and opening, so as to seal the opening shut until the tab is intentionally bent upwardly through the opening to break the seal and provide access to the contents of the can.

2 Claims, 7 Drawing Figures

EASY OPENING CAN TOP

TECHNICAL FIELD

This invention relates generally to beverage or other liquid-containing cans of the type having built-in, manually operable means for opening the can. More particularly, this invention is concerned with an improved sheet metal (preferably steel) can top which is formed with an integral, easily openable pull tongue arranged normally to occupy a closed position closely underlying an included opening in the can top, but which may be easily bent upwardly through such opening to a position projecting outwardly from, but integrally joined to the can top.

BACKGROUND ART

One popular type of beverage can in common use today is made of recyclable aluminum or an aluminum alloy and features a top formed with a normally flush, bend-down segment or tongue which is defined by an indented, weakened marginal break line extending partially through the thickness of the metal of the can top. A normally flush pull ring or tab is connected by a rivet to the pivot end portion of the bend-down tongue and is operable when manually pulled to break the marginal edge of the tongue free from the remainder of the can top and pivot the tongue downwardly into the can, thus forming an opening in the can top through which a beverage or other liquid in the can may be out-poured. Recyclable cans of the aforesaid type have a desirable advantage of retaining the pull tab and the associated bend-down tongue, but have a distinctly undesirable feature in that, upon opening of the can, the exposed and possibly germ-carrying upper surface of the bend-down tongue is plunged downwardly and immersed in the contents of the can with possible contaminating effects. Recyclable aluminum cans are also more slowly biodegradable and considerably more expensive than a comparable size steel can.

Another type of so-called easy-opening beverage can in common use today utilizes a steel body and top, wherein the top is formed with a generally radially oriented opening which is normally covered and sealed by a rupturable synthetic resin film adhesively secured to the underside of the can top. A pull tab in the form of a second layer or film of synthetic resin is adhesively applied to the outer surface of the can top in covering relation to the opening and in cohesive engagement with the area of the underlying, rupturable film which underlies the opening. When it is desired to open the can, the pull tab is "peeled" radially from the can top thus rupturing the portion of the underlying synthetic resin film in the area of the opening to permit the contents of the can to be outpoured through the opening.

While the aforesaid synthetic resin film-sealed steel cans are comparatively less expensive than recyclable alumimum cans, they lack the ability to retain their pull tabs upon opening of the can and are not suitable containers for carbonated beverages or other liquids under super atmospheric pressure.

DISCLOSURE OF THE INVENTION

The present invention provides an improved, easy opening can top in the form of a generally circular, thin gauge sheet steel body or blank which is formed with a perimetric, channel-form flange for crimp-rolled engagement with the upper rim portion of a cylindrical can body, and an integral tongue which is lanced from the body except along a single bend line and which defines in the blank an included opening. The tongue or tab is formed to closely underlie the included opening and has a marginal edge portion arranged normally to underlap and engage the underside of the blank adjacent the included opening. A strip of rupturable synthetic resin film is adhesively secured to the under side of the blank in covering relation to the tongue and opening. The tongue or tab is preferably formed in its intermediate region with an upstruck rivet formation which projects upwardly through the included opening and to which a pull ring or tab is connected in normally flat, overlying relation to the can top.

This invention also comprehends an improved method of making the aforesaid can top which includes the steps of: forming a generally circular, planar blank of thin gauge sheet steel having outer and under side surfaces; cutting and bending the blank to form therein an included opening underlaid and substantially occluded by an integral, bendable tongue joined with the blank by a single, transverse bend line; permanently stretching the blank in the area of said tongue to cause an edge of the tongue to underlie an edge of the blank adjacent the opening formed therein; adhesively securing a film of rupturable synthetic resin to the under side of the blank in covering relation to said tongue and opening to seal the opening; and securing a pull tab to the outer side surface of the tongue.

The principal object of this invention is to provide an easy opening can top which is characterized by its economy of manufacture, and its ability to retain its self-opening parts following opening of the can without immersing the self-opening parts in the contents of the can. Further objects and advantages of this invention will become more readily apparent as this description progresses.

BEST MODE FOR CARRYING OUT THE INVENTION

Figure 8:
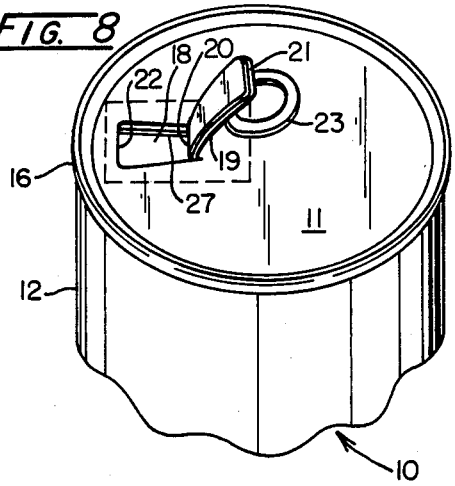
FIG. 8 is a fragmentary perspective view similar to FIG. 1, but showing the can in an open condition.

FIGS. 17 and 8 of the drawings illustrate the upper portion of a cylindrical beverage, or other liquid-containing, can 10 incorporating an easy opening can top 11 according to the present invention. In addition to its top 11, the can 10 comprises the usual cylindrical side wall or body 12 and a bottom closure wall, not shown.

Figure 2:
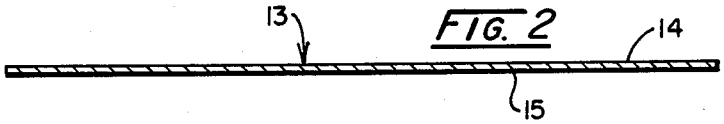
FIGS. 2 through 6 are medial, vertical, cross-sectional views illustrating sequential steps in the fabrication of a can top according to the invention.
Figure 3:
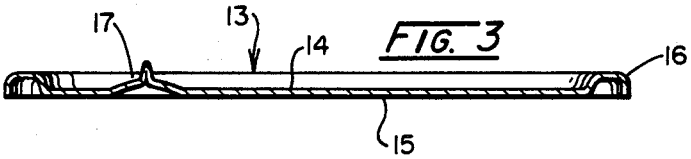
Figure 4:
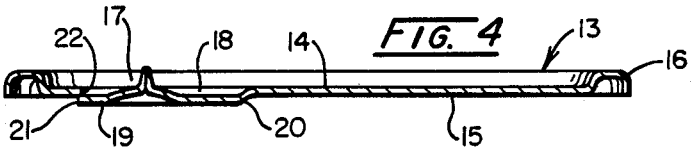

The can top is formed (as indicated in FIG. 2) from an initially planar, circular blank 13 of comparatively thin, light gauge, sheet metal, preferably steel, and includes an outer (top) side surface 14 and an under side surface 15. The blank 13 is press-bent (see FIG. 3) to form thereon the usual perimetric, channel-form connector flange 16 and an upstruck attachment teat or rivet formation 17. The blank is also lanced or press-cut (see FIG. 4) around the rivet formation 17 to form a generally radially oriented, rectangular opening 18 closely underlaid and substantially occluded by a bendable tongue 19 of corresponding shape. The tongue 19 is severed from the blank or body of the can top except along a single transverse bend line 20. During the formation of the tongue 19 the metal, particularly in the area of the bend line 20, is stretched and thinned slightly to cause at least a part of the marginal edge 21 of the tongue 19 to extend slightly beneath and underlap the adjacent, superposed edge 22 of the blank which defines the outer end of the opening 18. The overlapping edge 22 of the blank functions to impede accidental upward bending movement of the tongue 19 through the opening 18, as will be hereinafter explained in further detail.

Figure 5:
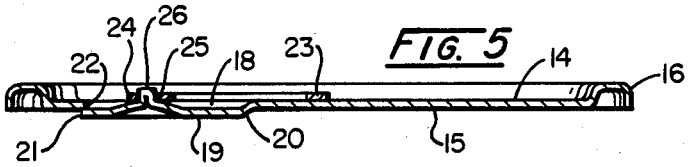
Figure 6:
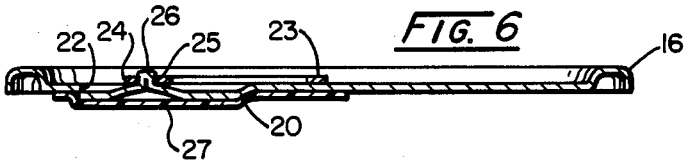

Following formation of the tongue 19 and opening 18, an annular, substantially flat, pull tab or ring 23 is secured to the tongue 19, as shown in FIG. 5. As illustrated more particularly in FIG. 1, the pull tab or ring 23 is formed with an integral, radially outwardly projecting nose portion 24 having an opening 25 therein which is placed over the teat or rivet formation 17. The rivet formation 17 is then "headed" or flattened, as at 26, to securely fasten the nose portion 24 of the pull tab 23 to the central or intermediate region of the tongue 19. The pull tab 23 is thus disposed normally in flat, closely overlying, parallel relation to the can top 11.

The can top is completed by adhesively securing a piece or patch 27 of a suitable, rupturable, synthetic resin film to the undersurface of the blank in underlying and covering relation to the tongue 19 and the opening 18. The patch 27 of synthetic resin film normally seals the opening 18 from the underside thereof.

Figure 7:
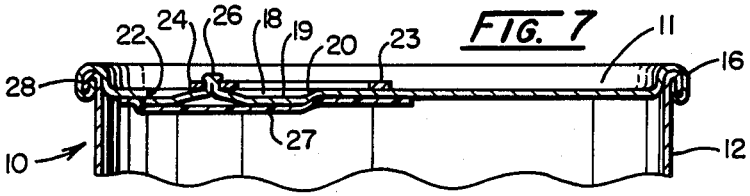
FIG. 7 is a fragmentary, medial, vertical cross-sectional view taken through the upper part of a can having an easy opening top embodying the invention.

Following the filling of the can body 12 with the selected beverage or other liquid, the top 11 is applied in the usual manner by crimp-rolling the connector flange 16 of the top to the upper rim portion 28 of the can body 12, as illustrated in FIG. 7.

Figure 1:
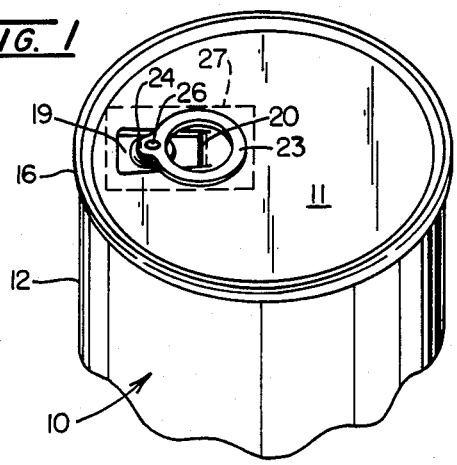
FIG. 1 is a fragmentary perspective view showing the upper portion of a can having an easy opening can top according to this invention.

As previously indicated, FIGS. 1 and 7 illustrate the can top in its normal, closed condition in which the opening 18 is substantially occluded by the closely underlying tongue 19 and is sealed closed by the synthetic resin film 27. In its closed condition, the pull tab or ring 23 lies in flat, parallel relation to the outer or upper surface 14 of the can top. When it is desired to open the can, the end of the ring 23 opposite its nose 24 is manually grasped and lifted from the upper surface of the can top and pulled upon to bend the tongue 19 upwardly from the bend line 20, as shown in FIG. 8. As the tongue 19 is bent upwardly, the synthetic resin film 27 is sheared and ruptured between the marginal edges of the tongue 19 and the adjacent edges of the top defining the opening 18, thus exposing the opening for the outflow of liquid from the can. It is important to note that the marginal edge portion 21 of the tongue 19 which slightly underlaps the edge 22 of the opening 18 functions to yieldably resist upward movement of the tongue through the opening until such time as the pull ring 23 is lifted and pulled upon to bend the tongue and thus free the edge 21 from beneath the edge 22. In addition to the overlapped engagement of the edges 22 and 21, the adhered synthetic resin film 27 further strengthens the tongue 19 against accidental bending and a consequent premature opening of the can.

As will be understood, the configuration and orientation of the opening 18 and tongue 19 may be varied according to the particular use to which the can is to be put and the nature of the can's contents. Also, the extent to which the marginal edge 21 of the tongue 19 underlaps the adjacent edge 22 of the opening may be varied, within limits, to thereby alter the pulling force required to disengage the edge 21 from the edge 22. The force applied to the ring 23 to bend the tongue 19 upwardly through the opening 18 to an open position should, ideally, range from five to seven pounds.

From the foregoing description, it will be apparent that this invention provides an improved, easy opening-type can top and method of fabricating such top. Cans embodying the improved top, when fabricated from sheet steel, are characterized by their economy of manufacture, their biodegradability, and their ability to physically retain the pull tab and opening tongue without contamination to the contents of the can.

While a single, preferred embodiment of the invention has been illustrated and described in detail, it will be understood that various modifications in design and details of construction may be made without departing from the spirit of the invention or the scope of the following claims.

We claim:

1. A can top comprising a generally circular body of thin, sheet steel having outer and under sides and an included opening underlaid by a correspondingly shaped, integral tongue lanced from said body except along a single, transverse bend line, said tongue having a marginal edge at least a portion of which is disposed beneath an edge of said body defining said opening wherby to impede accidental bending movement of said tongue upwardly through said opening; a film of rupturable synthetic resin adhesively secured to the under side of said body in covering relation to said tongue and opening; and a pull tab connected with said tongue and extending above the outer side of said body and providing a manually operable means for bending said tongue along said bend line and upwardly through said opening.

2. In a can top of the type which includes a generally circular, planar, sheet metal blank formed with a continuous perimetric attachment flange for crimp-rolled connection with a can body, that improvement which comprises a generally radially oriented tongue formed integrally with and cut from said blank except along a single, transverse bend line connecting said tongue with the remainder of said blank, said tongue defining an opening in said blank and having a marginal edge portion displaced below the general plane of said blank and a central portion projecting above the general plane of said blank and defining an attachment for a pull tab, at least a part of the marginal edge portion of said tongue being disposed normally in underlying engagement with an edge of the blank defining said opening; a rupturable synthetic resin film adhesively secured in underlying relation to said tongue and the adjacent area of said blank and normally sealing the opening formed in said blank; and a pull tab connected with the central portion of said tongue and providing manually operable means to pull said tongue upwardly through said opening, ruture said film and expose said opening.

* * * * *